United States Patent [19]

David

[11] Patent Number: 4,548,413

[45] Date of Patent: Oct. 22, 1985

[54] GAME DEVICE

[76] Inventor: Chris A. David, 17190 Garfield, Redford, Mich. 48240

[21] Appl. No.: 577,157

[22] Filed: Feb. 6, 1984

[51] Int. Cl.[4] ..... A63B 69/36

[52] U.S. Cl. ..... 273/186 A; 273/81.4; 273/193 B; 273/405; 273/346; 124/5

[58] Field of Search ..... 273/405, 181 B, 35 R, 273/193 B, 193 A, 67 R, 81.4, 323, 325, 326, 327, 186 R, 186 A, 346; 124/5

[56] References Cited

U.S. PATENT DOCUMENTS

| | | | |
|---|---|---|---|
| 1,556,473 | 10/1925 | Ballou | 273/81.4 |
| 1,877,820 | 9/1930 | Costello . | |
| 2,935,323 | 12/1957 | Cummings | 273/129 |
| 3,033,575 | 4/1960 | Hause | 273/193 |
| 3,466,049 | 9/1969 | Fox et al. | 124/5 X |
| 4,098,504 | 7/1978 | Gandy | 273/326 |
| 4,166,618 | 9/1979 | Sheem | 273/346 X |
| 4,233,952 | 11/1980 | Perkins | 124/5 |
| 4,273,339 | 6/1981 | Fortunato | 273/326 |
| 4,365,610 | 12/1982 | Cooper et al. | 124/5 |
| 4,387,898 | 6/1983 | Mangum | 273/326 X |

FOREIGN PATENT DOCUMENTS

| | | | |
|---|---|---|---|
| 753192 | 8/1923 | France | 124/5 |
| 1072092 | 3/1954 | France | 124/5 |
| 24798 | of 1910 | United Kingdom | 273/326 |

*Primary Examiner*—Paul E. Shapiro

*Attorney, Agent, or Firm*—Fisher, Crampton, Groh & McGuire

[57] ABSTRACT

A game device for holding and propelling a ball therefrom upon swinging movement which includes an elongated shaft with a chute member for holding the ball. The chute member is pivoted to the shaft for swinging movement through approximately 180° of arc and the shaft itself is intended to be held much as a golf club for swinging movement through an arc of swing in the manner of a golf club for propelling the ball therefrom. One end of the club is provided with a grip having indentations to guide the proper placement of the fingers for achieving a standard grip such as that used to hold a golf club.

4 Claims, 4 Drawing Figures

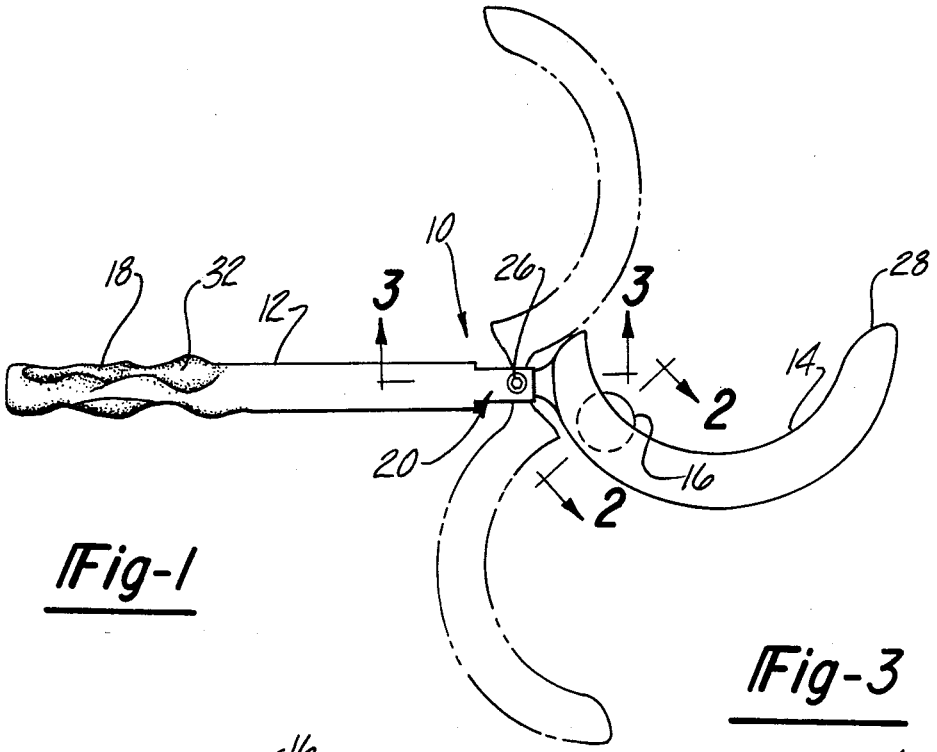
Fig-1
Fig-3
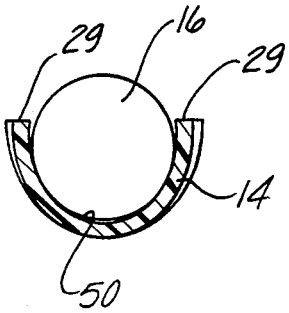
Fig-2
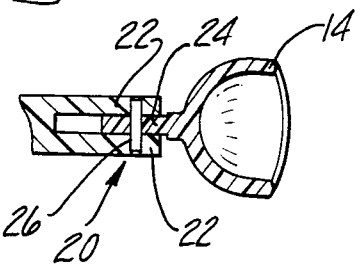
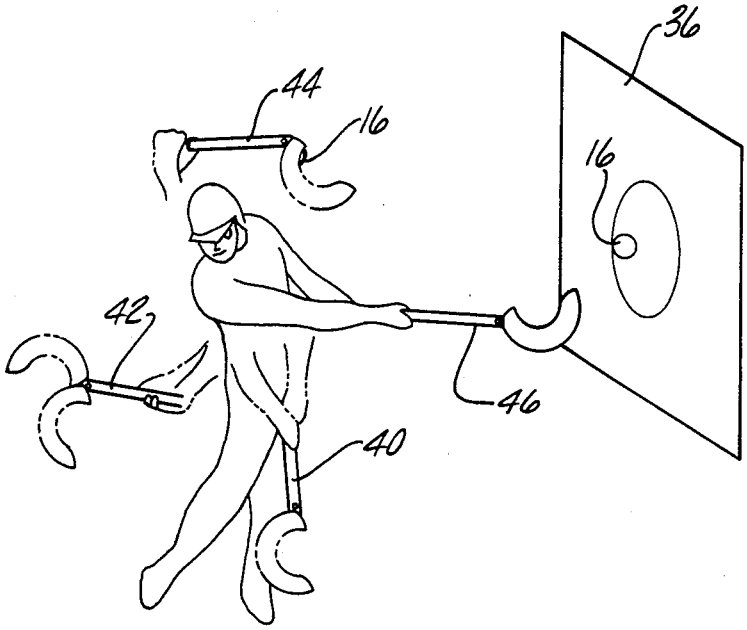
Fig-4

GAME DEVICE

This invention relates to game devices used to throw a ball and more particularly for apparatus particularly useful in training the user in the proper swing of a golf club.

The game device is intended to be used in much the same manner as a golf club except the game device is used for holding and propelling a ball from a chute rather than striking a ball.

It is an object of the invention to provide a game device for propelling a ball therefrom during swinging movement of the game device in an arc in the manner of a golf club.

It is another object of the invention to provide a game device having a molded grip with indentations insuring the proper placement of the hands in an overlapping two-hand grip, commonly used by golfers.

Still another object of the invention is to provide a game device by which a ball may be propelled toward a target offering an indication of the accuracy and consistency of the swing.

The objects of the invention are accomplished by a game device by which a ball can be propelled from a chute member which holds the ball during back-swing and during down-swing and follow through for delivery of the ball from the chute with the chute member being pivotable relative to the elongated shaft on which it is mounted for swinging through substantially 180° of arc relative to the shaft. One end of the shaft is provided with a molded hand grip which insures proper positioning of the hands during the swinging movement of the game device in a preferred grip such as used for holding a golf club.

A preferred embodiment of the golf training device is illustrated in the drawings in which:

FIG. 1 is a side view of the golf training device;

FIG. 2 is a cross-sectional view taken on line 2—2 in FIG. 1;

FIG. 3 is a cross-sectional view of a portion of the game device taken on line 3—3 in FIG. 1; and FIG. 4 is a diagrammatic representation of a player holding the golf training device showing various positions of the device from back swing through follow through.

The golf training device for propelling a ball is designated generally at 10 and includes an elongated shaft 12 and a chute member 14 for holding a ball 16 and propelling it therefrom.

The shaft 12 is formed with a hand grip 18 at one end and the opposite end is provided with a pivot bracket 20 for supporting the chute 14. The pivot bracket 20 is bifurcated to form a pair of tines 22 adapted to receive a post bracket 24 formed integrally with the chute 14. A pin 26 passes through the tines 22 and the post 24 to form a pivot axis for the chute member 14 relative to the shaft 12 which permits the chute to swing in an arc of approximately 180° relative to the shaft 12.

The chute 14 is curved through an arc of approximately 180° as seen in FIG. 1. The cross section of the chute 14 is generally semi-circular as seen in FIG. 2. The end of the chute member 14 adjacent to the pivot pin 26 is closed and the opposite end 28 of the chute member 14 is open to provide an exit for the ball 16. A portion of the chute 14 closest to the pivot 26 is slightly narrower than the remainder of the chute as thus seen in FIG. 2 in which opposite side walls 29 are more closely spaced than throughout the remainder of the chute toward the exit end 28. The spacing of the walls 29 serves to engage diametrically opposed points on the ball 16 to hold it in position during initial portions of the swinging movement of the game device.

The hand grip 18 at the end of the shaft 22 is provided with recesses 32 to receive the thumbs and fingers of two hands in a standard over-lapping golf grip. The recesses 32 insure that shaft 12 is properly gripped with a golf grip during swinging of the game device 10.

Both the shaft 12 and chute member 14 preferably are molded of plastic material. The ball itself preferably is of soft resilient material and has a diameter of approximately the size of a tennis ball. If desired, the exterior of the ball 16 can be provided with one element of hook and eye material marketed under the name VELCRO. The other element of such material is used on the surface of the target 36 so that when the ball 16 is hurled from the chute 14, it can attach itself to the target 36.

The game device 10 is intended to be held in the manner of a golf club and to be swingable in an imaginary plane through an arc simulating a typical golf swing. The ball 16 is first loaded into the chute member 14 near its pivoted end to be held by side walls 29. The swing is begun at the position indicated at 40 in FIG. 4, simulating the position of a golf player addressing a ball on a tee. The chute member 14, however, will be elevated above the ground since the game device 10 has an overall length shorter than a typical golf club. The player swings the device 10 in an arc in the same manner as a golf player beginning his back-swing at position 40 through the position indicated at 42 to the top of the back-swing at 44. The delivery swing begins at the top of the back-swing 44 and the game device 10 is moved in a plane through the same arc as a golf player would swing a golf club, that is, through the position indicated at 40 and through the follow-through position indicated at 46. During such swinging of the game device 10, the chute 14 swings relative to the shaft 12 about the pivot 26 so that the ball 16 is released from between the walls 29. During the delivery swing, the chute 14 and therefore the ball 16 moves a greater distance than, for example, the pivot 26 so that additional force in the form of centrifugal force is applied to propel the ball 16 from the chute 14 towards its target 36.

If the game device 10 is used with a ball 16 and target 36 employing hook and eye material, the chute 14 can be slightly modified by eliminating the constriction between the walls 29 seen in FIG. 2 and instead providing a patch of the same hook and eye material used on the target at the point indicated at 50 at the bottom of the chute 14. This will serve to hold the ball 16 in position after loading and during the back-swing of the game device 10.

It has been found that the game device 10 must be properly held in the same manner as a golf club and must be properly swung in the same manner as a golf club in a plane with the pivot pin 26 substantially perpendicular to the plane of swing in order to achieve proper, accurate delivery of the ball 18 from the chute 14. Any deviation of proper grip or proper swing effects the trajectory of the ball 16 in much the same manner as deviations in the grip and swing of a golf club. If a target 36 is used, the deviation is made apparent at the target.

The embodiments of the invention in which an exclusive property or provilege is claimed are defined as follows:

1. A game device for propelling a ball therefrom using a golf stance, grip and swing, said device comprising an elongated shaft having a hand grip to teach a proper golf grip at one end and a pivot bracket at the other end, a chute member for holding a ball, said chute having a U-shaped cross section so as to form a trough, said U-shaped section being narrower at one end and progressively wider toward the other end, said chute member being pivoted to said pivot bracket on said shaft for swinging movement of said chute member through an angle of approximately 180 degrees relative to said elongated shaft, said chute member being curved through an arc of approximately 180 degrees, said shaft and said chute member being swingable through an arc in a given plane with said pivot axis being disposed substantially perpendicular to said plane for delivery of a ball from said chute to facilitate a golf stance, grip and swing whereby the operator may practice a golf swing, stance and grip in a confined area by aiming a ball toward a target to improve the accuracy and technique of the golf swing.

2. The game device of claim 1 and further comprising means to temporarily hold the ball in said chute during initial swinging movement of said game device.

3. The game device of claim 2 wherein said means for temporarily holding the ball is formed by opposite walls in the chute adjacent to said pivot bracket for engaging diametrically opposite sides of the ball.

4. Golf game apparatus comprising: a ball propelling device, a ball, and a target, said ball propelling device comprising an elongated shaft, a hand grip at one end of said shaft to teach a golf stance, grip and swing, a chute member for holding a ball, said chute having a U-shaped cross section so as to form a trough, said U-shaped cross section being narrower at one end and progressively wider toward the other end, said chute member being pivoted to the other end of said shaft and being curved through a substantially circular arc of approximately 180 degrees, said shaft being swingable through an arc in a given plane with said pivot axis being disposed substantially perpendicular to the plane for delivery of a ball from said chute, said chute member being swingable through approximately 180 degrees relative to said elongated shaft during swinging movement of said game device for propelling said ball towards said target to facilitate a golf stance, grip and swing whereby the operator may practice a golf swing, stance and grip in a confined area by aiming a ball toward a target to improve the accuracy and technique of his golf swing.

* * * * *